US010470493B2

(12) United States Patent
Trainer

(10) Patent No.: US 10,470,493 B2
(45) Date of Patent: Nov. 12, 2019

(54) SYSTEMS AND METHODS FOR A SELF-EXTINGUISHING SMOKE DEVICE

(71) Applicant: Gary Trainer, The Woodlands, TX (US)

(72) Inventor: Gary Trainer, The Woodlands, TX (US)

( * ) Notice: Subject to any disclaimer, the term of this patent is extended or adjusted under 35 U.S.C. 154(b) by 136 days.

(21) Appl. No.: 15/694,920

(22) Filed: Sep. 4, 2017

(65) Prior Publication Data

US 2018/0110260 A1 Apr. 26, 2018

Related U.S. Application Data

(60) Provisional application No. 62/412,614, filed on Oct. 25, 2016.

(51) Int. Cl.
*A24F 19/14* (2006.01)
*A62D 1/00* (2006.01)

(52) U.S. Cl.
CPC ..... *A24F 19/145* (2013.01); *A62D 1/0092* (2013.01)

(58) Field of Classification Search
None
See application file for complete search history.

(56) References Cited

U.S. PATENT DOCUMENTS 3,542,039 A * 11/1970 Blakeway ..... A24F 19/145 131/235.1
5,598,854 A * 2/1997 Gillie ..... A24F 19/14 131/235.1
5,906,314 A * 5/1999 Kinay ..... A24F 19/14 131/235.1
2004/0149764 A1* 8/2004 Reeves ..... B65D 43/162 220/703
2012/0200236 A1* 8/2012 Huang ..... A24F 19/09 315/362

* cited by examiner

*Primary Examiner* — Michael J Felton
*Assistant Examiner* — Katherine A Will
(74) *Attorney, Agent, or Firm* — Pierson IP, PLLC

(57) ABSTRACT

Embodiments disclosed herein describe systems and methods for a self-extinguishing smoke device. In embodiments, the self-extinguishing smoke device may include an upper portion and a lower portion.

8 Claims, 9 Drawing Sheets

SYSTEMS AND METHODS FOR A SELF-EXTINGUISHING SMOKE DEVICE

CROSS-REFERENCE TO RELATED APPLICATIONS

This application claims a benefit of priority under 35 U.S.C. § 119 to Provisional Application No. 62/412,614 filed on Oct. 25, 2016, which is fully incorporated herein by reference in its entirety.

BACKGROUND INFORMATION

Field of the Disclosure

Examples of the present disclosure are related to systems and methods for a self-extinguishing smoke chamber. More particularly, embodiments relate to a device with chamber pre-filled with inert gas with a specific gravity larger than oxygen. When an ignited cigarette butt is dropped into the chamber, the ignited cigarette is extinguished.

Background

An ashtray is a receptacle for ash, typically from combustible consumer products, such as cigarettes. Ashtrays are typically made of fireproof material, such as glass, heat-resistant plastics, etc. Conventionally, ashtrays are designed as a shallow cylinder with an open upper surface and a flat base, which is able to rest on a table.

In use, when a combustible product is positioned on the ash tray, the combustible product will smolder for a few seconds. While smoldering, the combustible product will generate smoke and odor. This smoke and odor are able to escape into the immediate environment through an open upper surface of conventional ash trays.

Accordingly, needs exist for more effective and efficient systems and methods for a self-extinguishing smoke device that is pre-charged with inert gas with a specific gravity larger than air.

SUMMARY

Embodiments disclosed herein describe systems and methods for a self-extinguishing smoke device. In embodiments, the self-extinguishing smoke device may include an upper portion and a lower portion.

The upper portion of the device may include an open upper end, tapered sidewalls, open lower end, and a hinged arm.

The open upper end of the device may allow a user to position a combustible material, such as a cigarette, onto the tapered sidewalls. The tapered sidewalls may extend from the open upper end of the upper portion to the open lower end.

The tapered sidewalls may be utilized to minimize a diameter from open upper end to open lower end, and guide the combustible material to the open lower end. The open lower end may be a passageway allowing the combustible material to move from the upper portion to the lower portion of the device.

The hinged arm may be a projection on the upper portion that is configured to rotate between an open position and a closed position. In the open position, the hinged arm may not cover the open lower end. In the closed position, the hinged arm may be configured to cover the open lower end.

The lower portion of the device may be configured to be removably coupled to the upper portion of the device. For example, the lower portion may be configured to be screwed into the upper portion, press fit with the upper portion, etc. The lower portion may be a chamber, receptacle, etc. with a hollow open compartment. In embodiments, the lower portion may be pre-charged or filled with inert gas having a higher specific gravity than that of environmental air. Responsive to the combustible material passing through the open lower end, the inert gas may automatically extinguish the combustible material while retaining the smoke associated with the combustible material within the lower portion. This may be due to the properties of the inert gas, which may not allow the combustible material to interact with oxygen in the environmental air based on the weight of the inert gas.

To this end, embodiments allow a user to extinguish combustible material such as cigarettes. with a single hand without being forced to stub the butt of the combustible material. The lower portion of the device may be changeable and disposable which may eliminate messy clean ups, while providing an inexpensive way to reuse the device.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
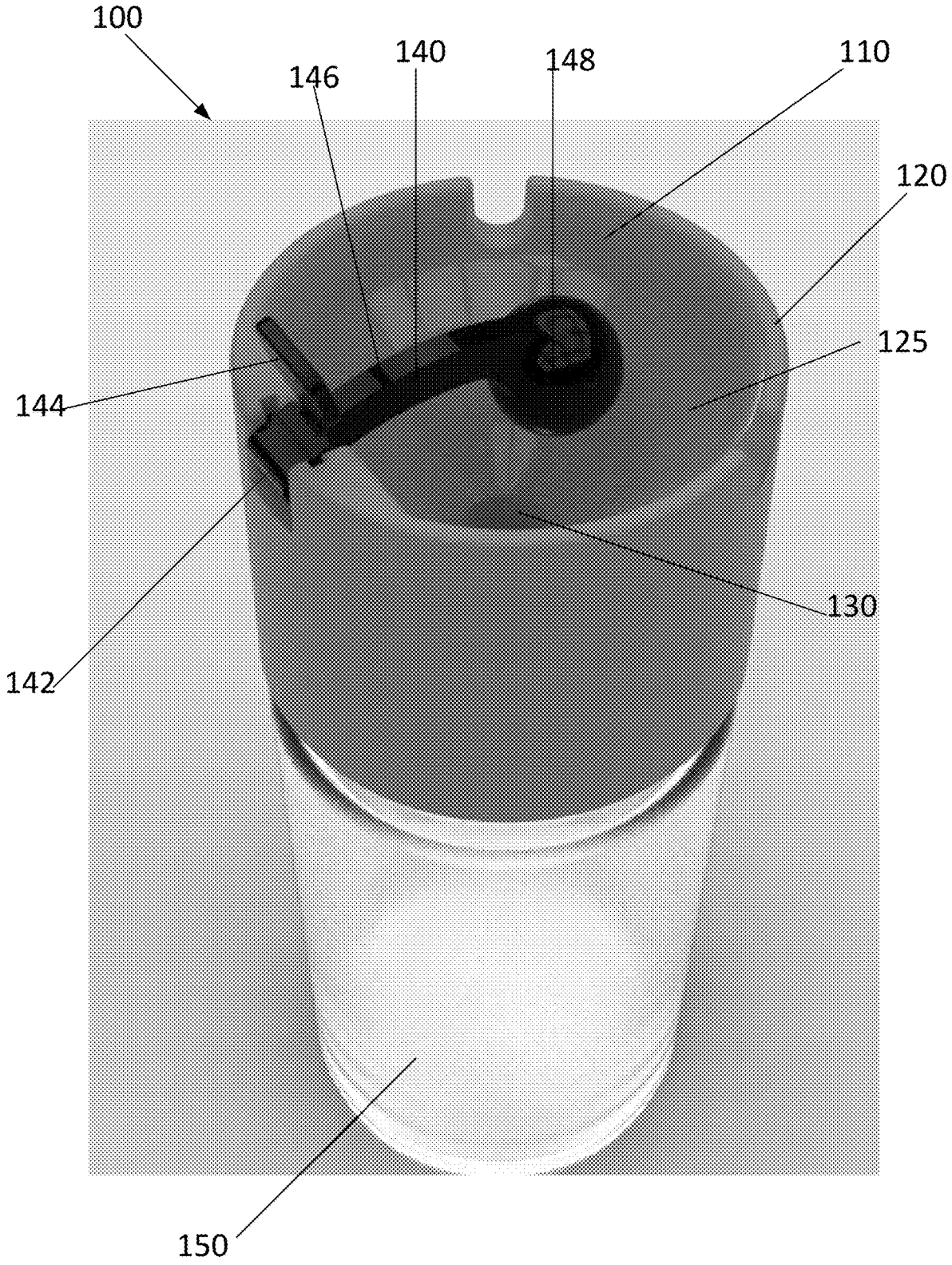
FIG. 1 depicts a system for a self-extinguishing smoke device, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present embodiments. It will be apparent, however, to one having ordinary skill in the art that the specific detail need not be employed to practice the present embodiments. In other instances, well-known materials or methods have not been described in detail in order to avoid obscuring the present embodiments.

Embodiments disclosed herein describe systems and methods for a self-extinguishing smoke device. In embodiments, the self-extinguishing smoke device may include an upper portion and a lower portion.

FIG. 1 depicts a self-extinguishing smoke device 100, according to an embodiment. Device 100 may include an upper portion 110 and a lower portion 150.

Upper portion 110 may be configured to be removably coupled to lower portion 150, such that upper portion 110 may be positioned above lower portion 150. In embodiments, upper portion 110 may be configured to be screwed into lower portion 150, or vice versa. Upper portion 110 may include open upper end 120, tapered sidewalls 125, open lower end 130, and hinged arm 140.

Open upper end 120 may a top most boundary of upper portion 110, and open upper end 120 may be an uncovered surface. Open upper end 120 may have a first circumference extending around upper portion 110.

Tapered sidewall 125 may be positioned between open upper end 120 and open lower end 130. Tapered sidewall 125 may be angled to decrease the circumference of open upper end 120 to open lower end 130. As such, tapered sidewall 125 may form a funnel that is configured to guide a combustible material from open upper end 120 to open lower end 130. Responsive to a user positioning the combustible material on an area of tapered sidewall 125 proximate to open upper end 120, the combustible material may slide down tapered sidewall 120 to open lower end 130.

Open lower end 130 may be a bottommost boundary of open portion 110. Open lower end 130 may have a second circumference that is smaller than open upper end 120. Open lower end 130 may act a conduit where a combustible material may move from upper portion 110 to lower portion 150. In embodiments, open lower end 130 may be selectively covered by hinged arm 140, such that in a first mode open lower end 130 may be unobstructed, and in a second mode open lower end 130 may be covered. In the first mode, the hinged arm shall remain in the open position due to gravity. In the second mode, the hinged arm shall remain in the closed position due to gravity.

Hinged arm 140 may be a projection positioned on open upper end 130 that is configured to rotate. Hinged arm 140 may include a hinge 142, tab 144, arm 146, and ball 148.

Hinge 142 may be configured to allow hinged arm 140 to rotate around an axis that is embedded within upper portion 110. In embodiments, hinge 142 may be positioned within open upper end 120.

Tab 144 may be a projection extending away from arm 146. Tab 144 may be a planar surface that allows a user to more easily rotate hinged arm 140.

Arm 146 may be a shaft, projection, etc. extending from hinge 142 to ball 148. Responsive to moving arm 146, ball 148 may correspondingly move. In embodiments, arm 146 may be a curved shaft with a first width. The curvature of arm 146 may assist arm 146 moving in an arced path to allow ball 148 to cover open lower end 130.

Ball 148 may be positioned on an end of arm 146, and may be configured to be positioned over and away from open lower end 130. In a first mode, ball 148 may be configured to be positioned away from open lower end 130, such that a passageway is formed from upper portion 110 to lower portion 150. In a second mode, ball 148 may be configured to be positioned on top of open lower end 130 to block the passageway between upper portion 110 to lower portion 150. In embodiments, ball 148 may have a third circumference, which is larger than the circumference of open lower end 130 but smaller than the circumference of open upper end 110. Furthermore, the third circumference may be greater than the width of arm 146. By ball 148 being cylindrical in shape, the cylinder may sit on open lower end 130 to form a seal in the second mode.

Lower portion 150 may be a device that is configured to be removably coupled to upper portion 110. Lower portion 150 may be a hollow and replaceable chamber, receptacle, cartridge, etc. that is configured to be pre-filled with inert gas. In embodiments, the inert gas may be 1,1,1,2-tetrafluoroethane, or any other type of harmless, colorless, odorless, and non-hazardous gas within a specific gravity higher than that of smoke and/or the environmental air. For example, the 1,1,1,2-tetraflurorethane may have a specific gravity that is 3.2 times higher than environmental air. Due to the specific gravity of the pre-filled inert gas within lower portion 150, responsive to positioning combustible material within lower portion 150, the pre-filled inert gas may automatically extinguish the combustible material. Because the inert gas has a high specific gravity, the inert gas will not leave lower portion 150 through open lower surface 130. Additionally, the inert gas may displace atmospheric oxygen positioned within lower portion 150, which may lead the oxygen concentration to be below a specific threshold level required for combustion to be maintained. As such, the combustible material assists in its own extinction, consuming oxygen in the flames. In embodiments, lower portion 150 may be comprised of a heat resistant, translucent material, such as glass. Lower portion 150 may be any desired shape and/or size, which may be large enough to hold approximately eighty cigarette butts and fit into an automobile cup holder.

Figure 2:
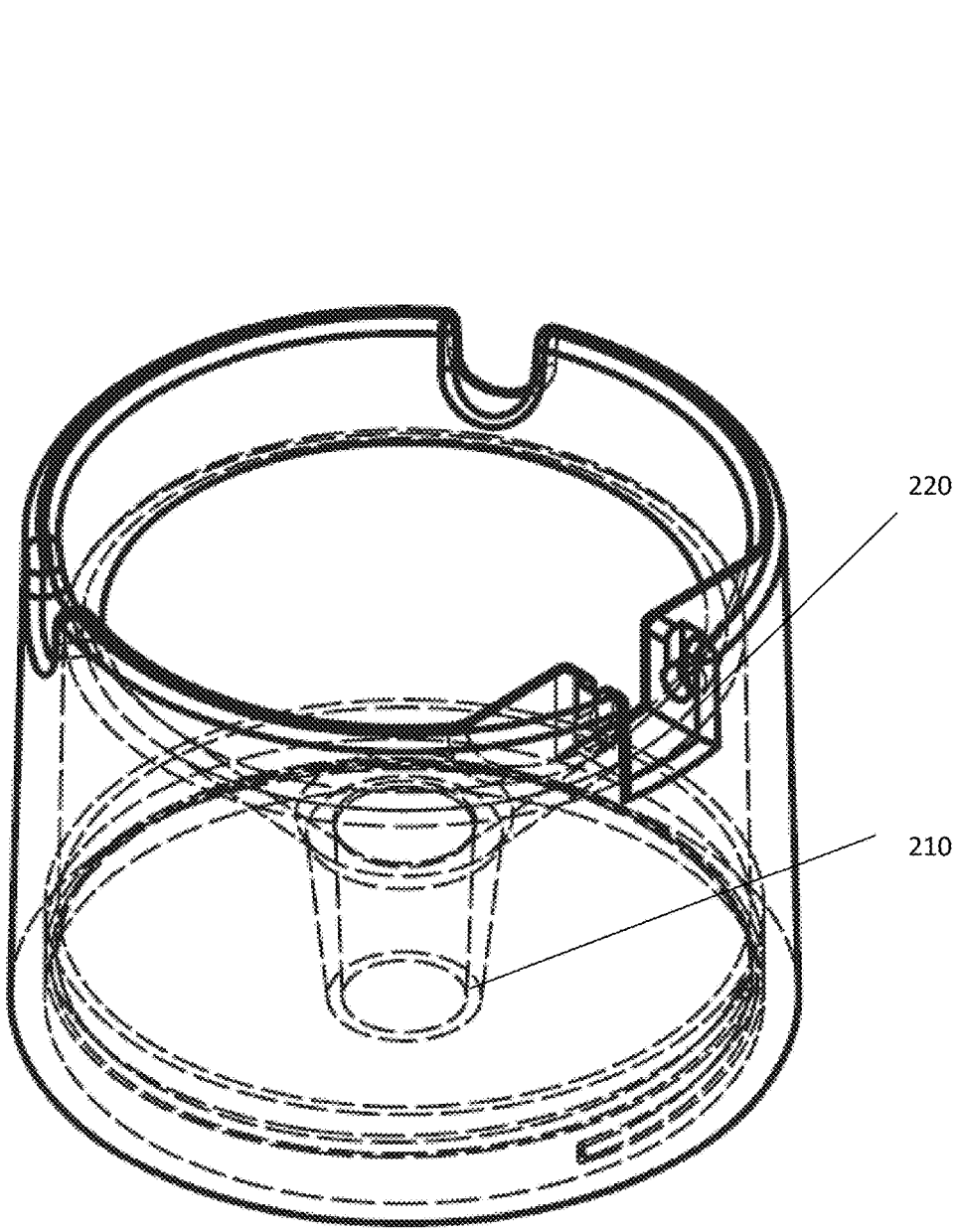
FIG. 2 depicts an upper portion of a system for a self-extinguishing smoke device.

FIG. 2 depicts an upper portion 110, according to an embodiment. Elements depicted in FIG. 2 may be substantially the same as those discussed above. For the sake of brevity, an additional description of these elements is omitted.

As deposited in FIG. 2, Upper portion 110 may be configured to be removably coupled to an upper edge of lower portion 150. Upper portion 110 may be shaped like a funnel, wherein a lower surface 210 of the funnel is configured to extend into a hollow chamber within lower portion 150. In use, upper portion 110 may be decoupled from lower portion 150, and recoupled to a second lower portion 150. Because lower portion 150 is prefilled with inert gas with a high specific gravity, the gas within lower portion 150 may not escape out an upper surface of lower portion 150.

Furthermore, the upper circumference of upper portion 110 may include a tab receiver 220. Tab receiver 220 may be configured to be an insert where hinged arm 140 may be inserted.

Figure 3:
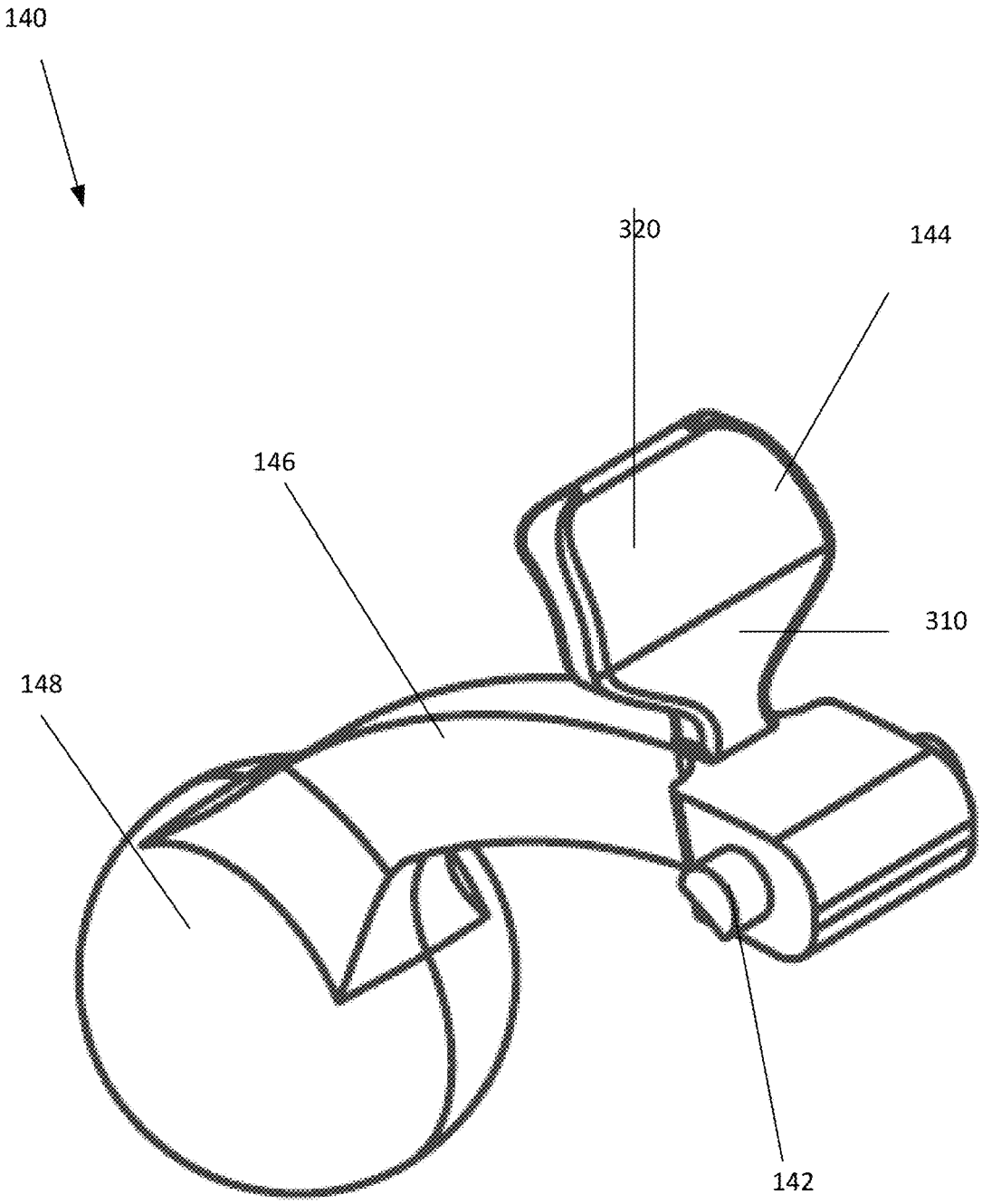
FIG. 3 depicts a hinged arm, according to an embodiment.

FIG. 3 depicts a hinged arm 140, according to an embodiment. Elements depicted in FIG. 3 may be substantially the same as those discussed above. For the sake of brevity, an additional description of these elements is omitted.

As depicted in FIG. 3, tab 144 of hinged arm 140 may be configured to project away from curved arm 146. Tab 144 may include a first portion 310 and a second portion 320.

First portion 310 may be a linear projection that is configured to extend away from arm 146 in a direction that is orthogonal to arm 146. In the first mode, the sidewall of first portion 310 proximate to hinge 142 may be positioned directly adjacent to a sidewall of upper portion 110. Therefore, first portion 310 may act as a stopper when tab 144 is in the first mode, which may limit the outward rotation of hinged arm 140.

Second portion 320 may be a curved projection that is positioned on an outer end of first portion 310. The curved projection may arc towards the distal end of arm 146. The curved projection may be configured to create space between the sidewall of upper portion and tab 144 when tab 144 is in the first mode. A user may insert their finger between the space to rotate hinged arm 140 when hinged arm 140 is in the first mode.

Figure 4:
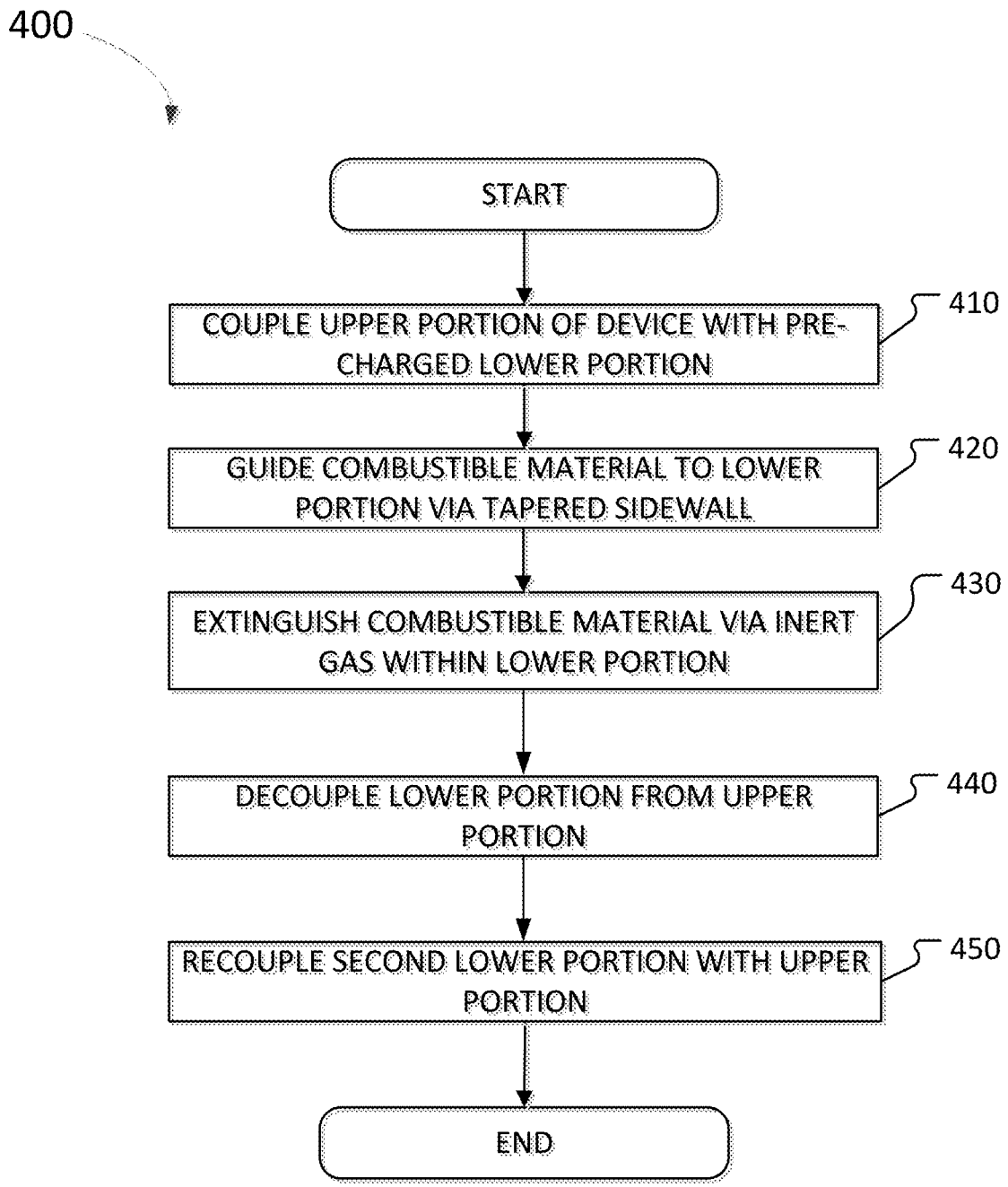
FIG. 4 depicts a method for a self-extinguishing smoke device, according to an embodiment.
Figure 5:
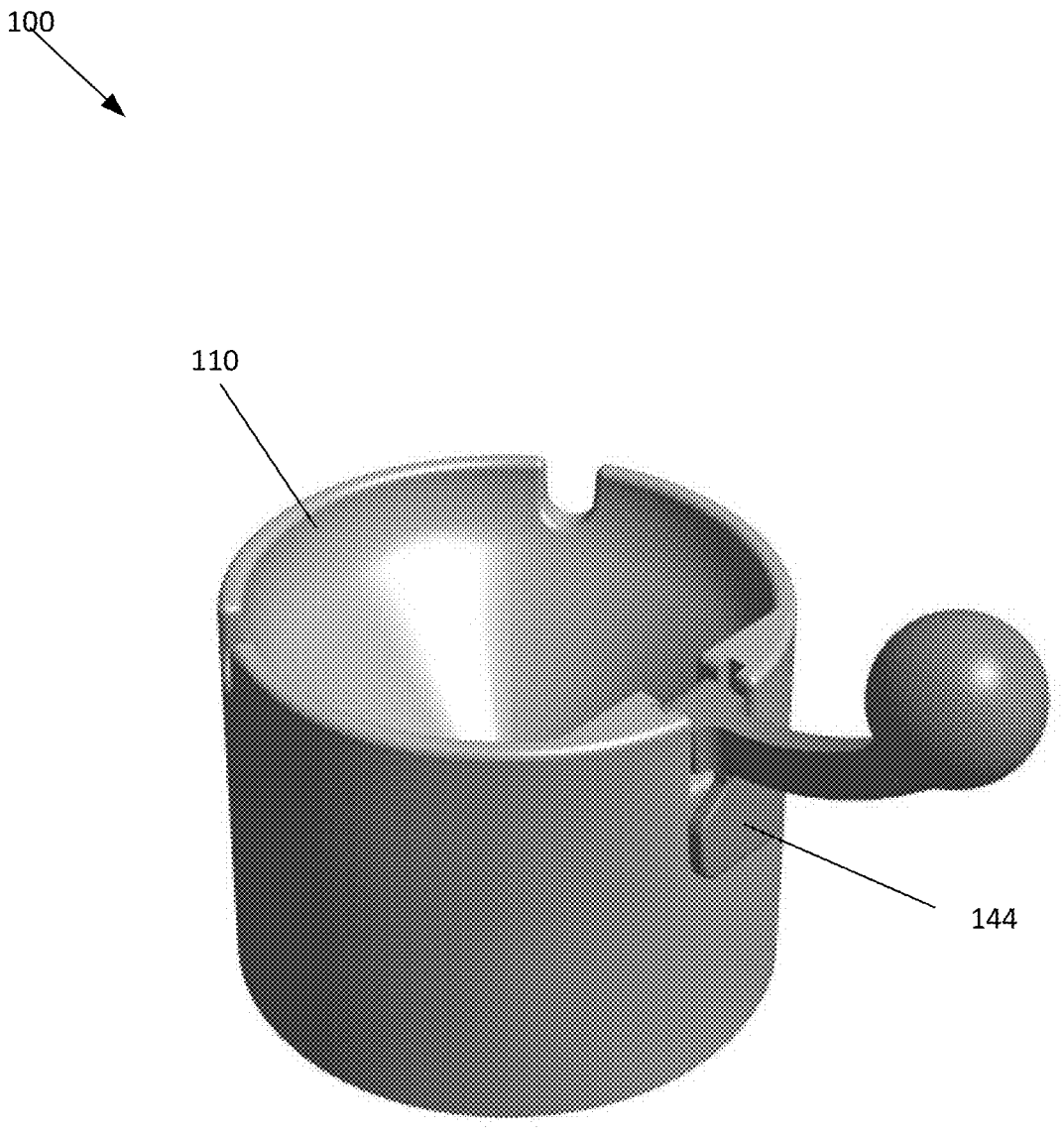
FIGS. 5-8 depicts an upper portion of a system for a self-extinguishing smoke device, according to an embodiment.
Figure 6:
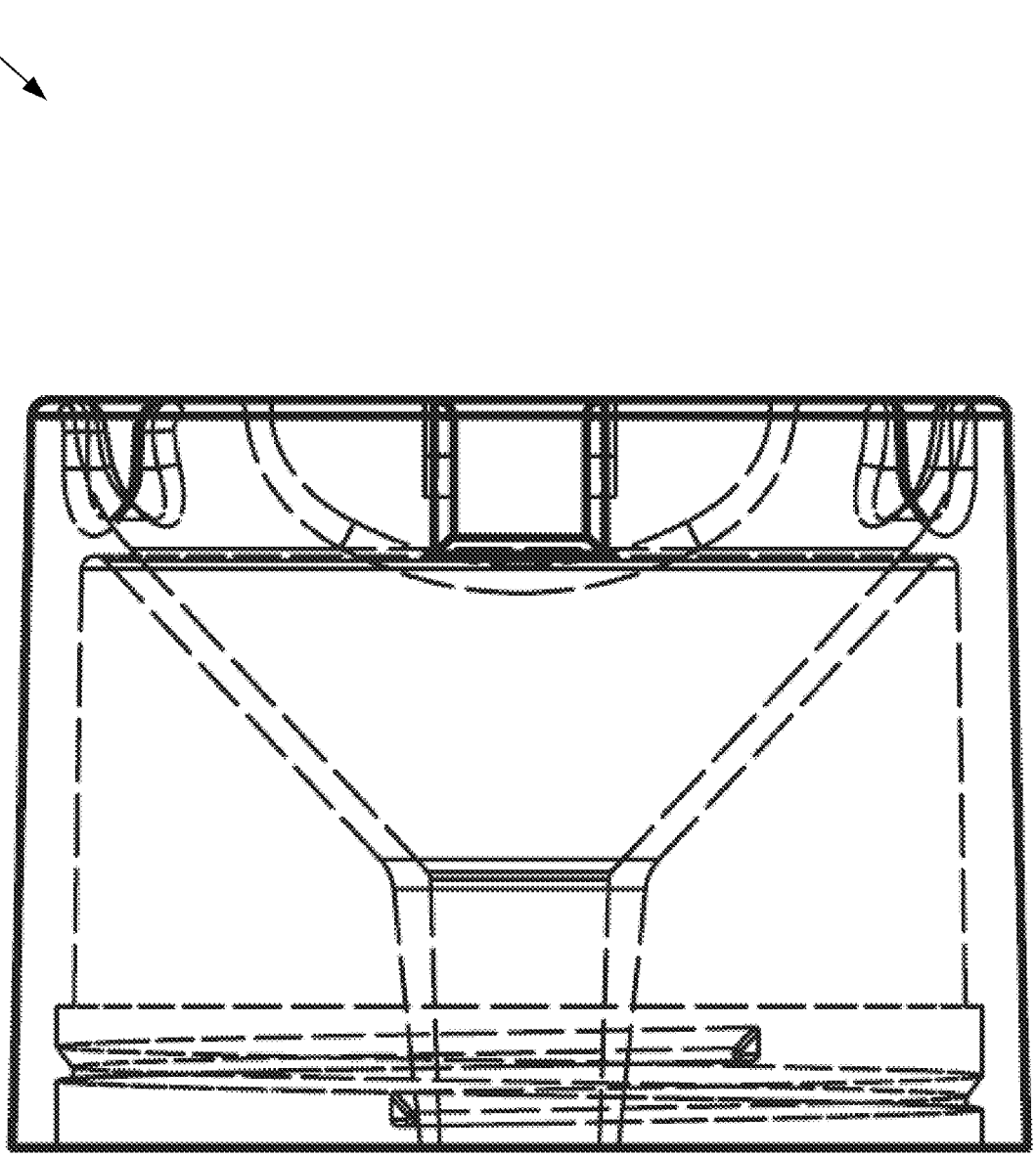
Figure 7:
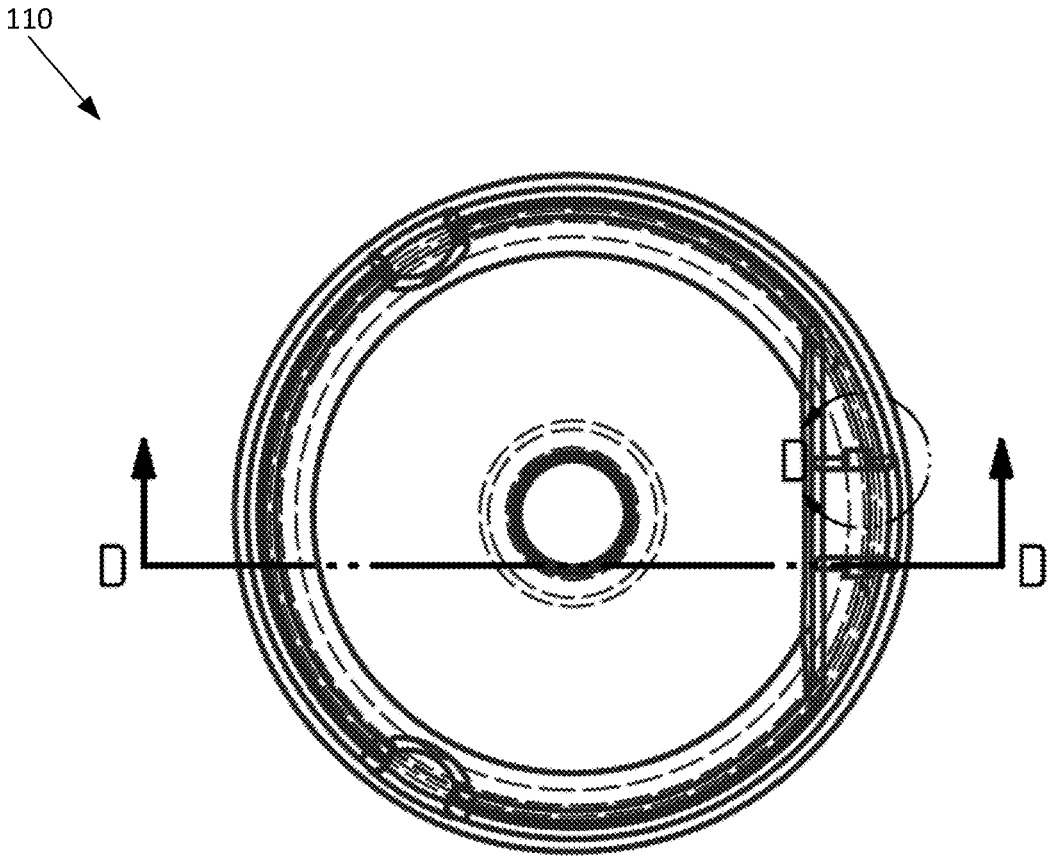
Figure 8:
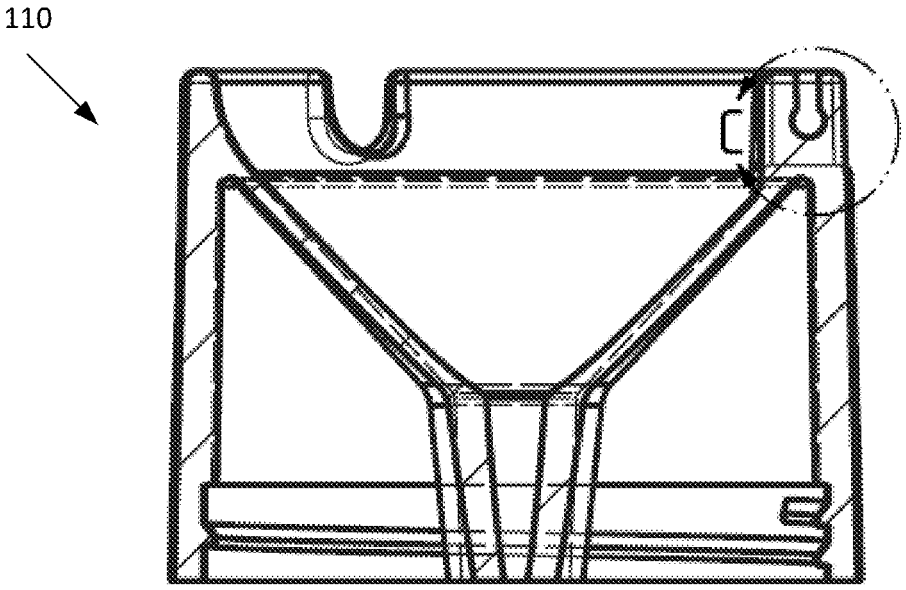

FIG. 4 depicts a method 400 for a self-extinguishing smoke device, according to an embodiment. The operations of method 400 presented below are intended to be illustrative. In some embodiments, method 400 may be accomplished with one or more additional operations not described, and/or without one or more of the operations discussed. Additionally, the order in which the operations of method 400 are illustrated in FIG. 4 and described below is not intended to be limiting.

At operation 410, an upper portion of a device may be coupled with a pre-charged lower portion of the device. Wherein the lower portion may be pre-charged with inert gas with a higher specific gravity than environmental air.

At operation 420, combustible material, such as a cigarette may be positioned on the upper portion of the device. Tapered sidewalls of the upper portion may guide the combustible material to an opening extending into the lower portion.

At operation 430, responsive to the combustible material entering into the lower portion of the device, the inert gas may automatically and quickly extinguish the combustible material.

At operation 440, the lower portion may be decoupled from the upper portion. This may allow a user to quickly and efficiently dispose of combustible material positioned within the lower portion.

At operation 450, a second lower portion may be coupled with the upper portion so the device may be reused.

FIGS. 5-8 depicts upper portion 110, according to an embodiment. Elements depicted in FIGS. 5-8 may be substantially the same as those discussed above. For the sake of brevity, an additional description of these elements is omitted.

Figure 9:
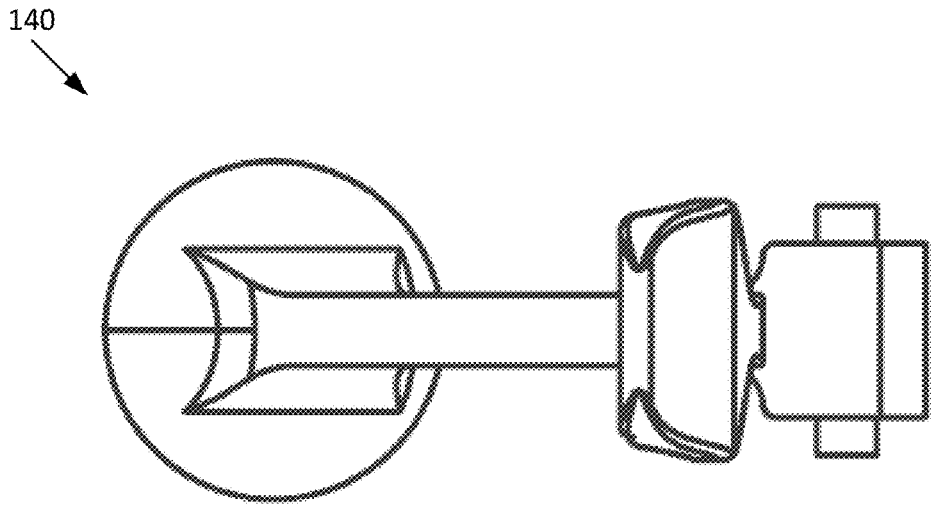
FIGS. 9-11 depicts a hinged arm for a self-extinguishing smoke device, according to an embodiment.
Figure 10:
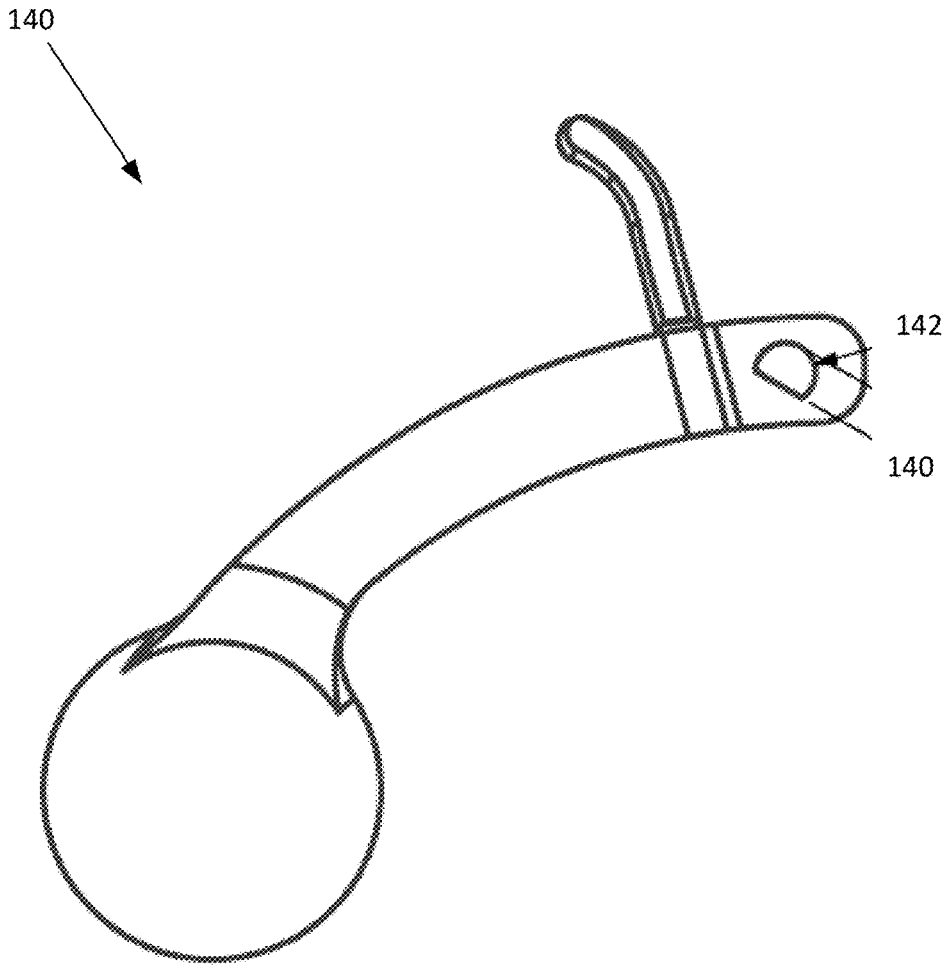
Figure 11:
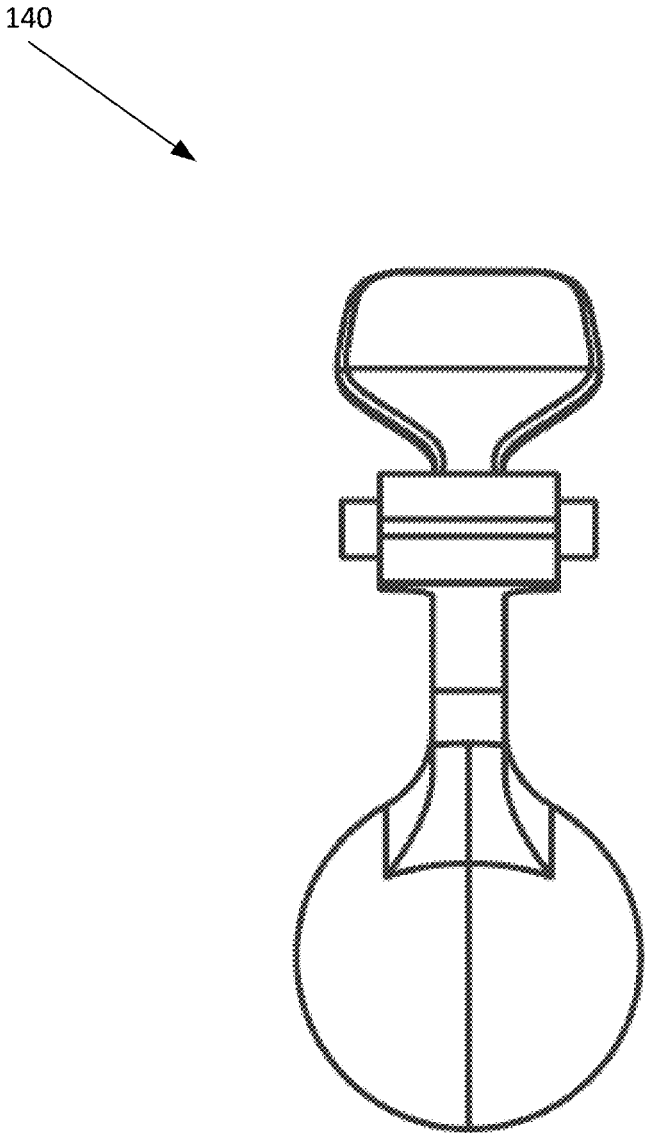

FIGS. 9-11 depicts a hinged arm 140, according to an embodiment. Elements depicted in FIGS. 9-11 may be substantially the same as those discussed above. For the sake of brevity, an additional description of these elements is omitted.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A self-extinguishing smoke device, comprising:

an upper portion including an open upper end and an open lower end, wherein tapered sidewalls continuously extend from a first circumference of the open upper end to a second circumference of the open lower end;

a curved arm coupled to the first circumference of the upper portion via a hinge positioned on a proximal end of the arm, the arm including a ball positioned on a distal end of the arm and a tab projecting away from the arm, the ball being configured to be positioned away from the open lower end in a first mode and the ball being configured to cover the open lower end in a second mode, the tab being positioned on a first surface of the curved arm between the hinge and the ball, wherein the tab includes a planar portion and a curved portion;

a lower portion being configured to be removably coupled with the upper portion, the lower portion being pre-charged with inert gas having a higher specific gravity than that of air, wherein the open lower end of the upper portion provides a passageway into the lower portion, the tab being configured to be positioned over the first circumference in the first mode and a surface of the planar portion of the tab being positioned adjacent to an outer sidewall of the upper portion in the second mode.

2. The self-extinguishing smoke device of claim 1, wherein the curved portion of the tab does not touch the outer sidewall of the upper portion in the first mode.

3. The self-extinguishing smoke device of claim 1, wherein the ball has a larger diameter than that of the open lower end and a smaller diameter than the first circumference.

4. The self-extinguishing smoke device of claim 1, wherein the open lower end is positioned within the lower portion when the lower portion is coupled to the upper portion.

5. The self-extinguishing smoke device of claim 1, wherein the arm is curved between the tab and the ball.

6. The self-extinguishing smoke device of claim 1, wherein the arm has a smaller width than the ball.

7. The self-extinguishing smoke device of claim 1, wherein in the second mode portions of a circumference of the ball are positioned adjacent to the tapered sidewalls.

8. The self-extinguishing smoke device of claim 1, wherein the hinge is above the tapered sidewalls.

* * * * *